United States Patent [19]

Stark

[11] 4,095,512

[45] Jun. 20, 1978

[54] WINDING OF UNIFORM DIAMETER TUBES

[75] Inventor: Martin H. Stark, Saginaw, Mich.

[73] Assignee: Arrow Paper Products Company, Saginaw, Mich.

[21] Appl. No.: 674,950

[22] Filed: Apr. 8, 1976

[51] Int. Cl.[2] ..... B31C 3/00

[52] U.S. Cl. ..... 93/81 R; 93/94 R; 83/368; 162/120; 162/194

[58] Field of Search ..... 83/368; 93/77 R, 81 R, 93/83, 94 R; 162/120, 194, 285, 286

[56] References Cited

U.S. PATENT DOCUMENTS

| | | | |
|---|---|---|---|
| 2,708,394 | 5/1955 | Allen et al. | 93/81 R |
| 3,073,218 | 1/1963 | Roediger et al. | 93/81 R |
| 3,417,645 | 12/1968 | Brock | 83/368 |
| 3,871,290 | 3/1975 | Verboom | 162/194 X |

*Primary Examiner*—Roy Lake
*Assistant Examiner*—Paul A. Bell
*Attorney, Agent, or Firm*—Learman & McCulloch

[57] ABSTRACT

The winding of tubes of substantially uniform diameter from sheet stock which varies in thickness comprises slitting the stock along one edge as it is unwound from a supply roll to form a web of predetermined width and subsequently cutting the web transversely to form successive blanks of predetermined length and width which are wound upon themselves from one side to the other to form convolutely wound tubes. Should the diameter of the tubes vary due to an increase or decrease in the thickness of the sheet stock, the width of the web is varied inversely with changes in the thickness of the stock.

12 Claims, 7 Drawing Figures

WINDING OF UNIFORM DIAMETER TUBES

This invention relates to apparatus and methods for the production of substantially uniform diameter, convolutely wound tubes formed from sheet stock which varies in thickness. More particularly, the invention relates to the winding of substantially uniform diameter tubes from paper.

Convolutely wound paper tubes have many applications and are formed by a number of different methods. In many instances the diameter of such a tube may vary considerably without causing any adverse consequences. In other instances, however, appreciable differences in tube diameter cause substantial difficulties. For example, rigid control of the diameter of a tube adapted to be used as a window shade roller is important in order that the fittings at the opposite ends of the tube may be assembled with the latter without modification. Diameter control over cores adapted for use with computer paper rolls also is essential in order that the overall diameter of the paper roll may be accommodated in the space provided in the computer printer.

The stock from which shade and other rollers are formed comprises sheet material wound in a roll about a mandrel. The thickness of the sheet material is specified by the purchaser, of course, but the manufacturer of the sheet material cannot always maintain the thickness of the sheet uniform from roll to roll, nor can the manufacturer always maintain uniformity of sheet thickness within a single roll. Accordingly, it is not uncommon for the thickness of the sheet material to vary up to 0.006 inch. Thus, if two blanks having the same length and width dimensions are wound about the same winding mandrel to form two tubes, and if the one blank has a thickness greater than that of the other blank, the diameter of the tube wound from the thicker blank will be larger than the diameter of the tube wound from the thinner blank. Unless the diameters of successively wound tubes are inspected at frequent intervals, an undetected variation in sheet thickness may require the scrapping or subsequent modification of a large number of tubes.

An object of the invention is to provide apparatus and methods for winding tubes of substantially uniform diameter from sheet material even though the thickness of such material may vary.

Another object of the invention is to provide such apparatus and methods for the continuous winding of successive tubes of substantially uniform diameter from sheet material which varies in thickness and wherein adjustments necessary to maintain uniformity of the tubes' diameter may be made without interruption of the operation of the apparatus.

Other objects and advantages of the invention will be pointed out specifically or will become apparent from the following description when it is considered in conjunction with the appended claims and the accompanying drawings, in which:

Figure 5:
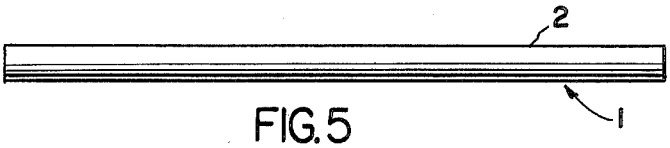
FIG. 5 is a side elevational view of a typical tube formed in accordance with the invention.
Figure 6:
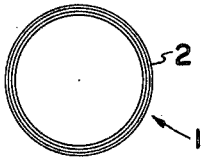
FIG. 6 is an end elevational view, on a greatly enlarged scale, of such a tube.

A tube formed in accordance with the invention is designated by the reference character 1 in FIGS. 5 and 6 and comprises a cylinder or sleeve 2 of convolutely wound sheet material such as paper. The paper from which the tube 1 is wound is supplied in a roll 3 wound on a core through which extends a shaft 4 the opposite ends of which may be journaled in pillow blocks 5 located at one end of unwinding machinery 6 of known construction having a frame F. The sheet material extends from the roll 3 as a web 7 which is trained around a series of rolls 8, 9, 10, 11, 12, 13, 14, 15, 16, and 17 and thence passes between a pair of driving rolls 18 and 19 which are operable to unwind the web continuously from the roll 3. Between the rolls 11 and 12 is a moistening roll 20 which rotates in a bath 21 of water so as to apply moisture to one surface of the web along one edge to temper and soften the paper. Between the water bath 21 and the drive rollers 18 and 19 is a glue pot 22 within which rotates a roll 23 which applies a coating of adhesive to the opposite surface of the web 7.

Downstream from the driving rolls 18 and 19 is a periodically oscillating knife 24 which cooperates with a knife edge 25 at intervals to cut the web 7 into successive rectangular blanks 26 of uniform length.

Downstream of the knife 24 is a support 27 on which is mounted a reciprocable carriage 28 to which each blank 26 is delivered in succession. At one side of the carriage is a frame member 29 provided with a plurality of pins 30 which engage the blank 26. Movement of the carriage 28 to the right by means not shown from the position shown in FIG. 1 transfers the blank 26 to the dotted line position shown in FIG. 1 and introduces that side edge of the blank adjacent the pins 30 into a slot 31 formed in a mandrel 32 that is rotatable about its own longitudinal axis by means not shown. Following insertion of the one edge of the blank 26 into the winding mandrel 32, the carriage 28 is returned to the position shown in FIG. 1 and the mandrel 32 is rotated to wind the blank 26 into the tube 1. The carriage 28 then receives another blank 26, following which it again is moved to the right, as viewed in FIG. 1.

Figure 1:
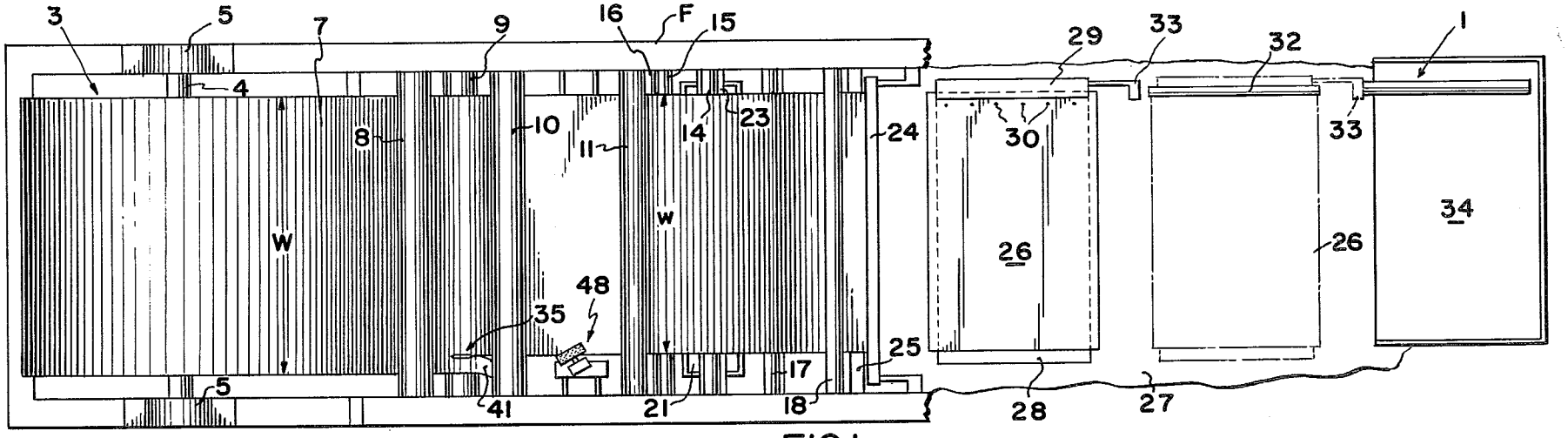
FIG. 1 is a schematic, top plan view of apparatus for practicing a preferred process of winding tubes of substantially uniform diameter.

The carriage 28 includes a stripping finger 33 which engages the previously wound tube on the mandrel 32 and pushes the latter onto a receiving tray 34 which lies to the right of the mandrel 32, as viewed in FIG. 1.

The apparatus thus far described, as well as its manner of operation, is well known and forms no part of the invention per se, aside from the manner in which it cooperates with the apparatus hereinafter described.

The roll 3 of sheet material as supplied by its manufacturer has a web length of many hundreds of feet and a width dimension W as specified by the purchaser. The web also has a nominal thickness as specified by the customer, but such thickness may vary by several thousandths inch over the length of the web. If each blank 26 has a width corresponding to the dimension W and if each such blank is wound about the mandrel 32, then it will be understood that a tube formed from a first blank 26 having a thickness greater than that of a succeeding blank will have a diameter greater than that of the succeeding tube, and that the difference in the diameters of the two tubes will be due to the difference in thickness of the two blanks.

Apparatus constructed in accordance with the invention includes cutting or slitting mechanism 35 that is adapted to cut the web 7 longitudinally as it is unwound from the roll 3 so that the portion of the web 7 downstream from the slitter mechanism 35 has a width *w* which is less than the width W. The mechanism 35 comprises a rotary knife 36 journaled in a housing 37 for rotation about an axis 38. The housing 37 is vertically adjustable in a carrier 39, a spring pressed adjusting screw 40 yieldably reacting between the carrier and the housing 37 for adjusting the knife 36 to a position in which its cutting edge engages the roll 9 and trims a strip 41 of predetermined width from one edge of the web 7. The adjusting screw could be replaced by other types of devices for resiliently maintaining the knife in slitting condition. For example, a conventional air cylinder could be used in lieu of the screw mechanism.

The carrier is mounted on a dovetailed guide 42 that is secured to a portion 43 of the frame F, the arrangement being such that the carrier 39, together with the knife 36, is adjustable transversely of the web 7 with the knife remaining in engagement with the roll 9.

Operating means for adjusting the carrier 39 and the knife 36 is designated generally by the reference character 44 and comprises a threaded shaft 45 journaled adjacent one end in a bearing 46 fixed to the machine frame F and extending through a correspondingly threaded opening in the carrier 39. A hand wheel 47 fixed to the shaft 45 facilitates rotation of the latter. Rotation of the shaft 45 in a selected one of two different directions will cause the knife 36 to be adjusted transversely of the web 7 so as either to increase or decrease the width of the trimmed strip 41 and, consequently, to decrease or increase, respectively, the width *w* of the web 7.

In the production of wound tubes for some purposes it is desirable that the trailing end of the wound blank of sheet material be reduced in thickness so as to avoid the presence of an abrupt edge at the outer surface of the tube. Although the trailing end of the wound blank may be shaved following winding of the tube, it is preferred to reduce the thickness of the trailing end of the blank prior to its being wound to form the tube.

According to the invention, the edge of the web 7 which has been trimmed by the slitting mechanism 35 will form the trailing end of each blank 26 and such edge of the web 7 may be reduced in thickness by a skiving mechanism 48.

In the disclosed embodiment, the skiving mechanism 48 comprises a rotary grinding or skiving wheel 49 fixed to the armature shaft 50 of an electric motor 51 which is secured to a reciprocable carriage 52 slidably mounted on guide rods 53 carried by the frame F. The frame also carries a bearing 54 in which is journaled one end of an operating shaft 55 that is threaded to correspond to the threading of the shaft 45. The shaft 55 passes through a correspondingly threaded opening in the carriage 52 so that rotation of the shaft in one direction or the other will cause movement of the carriage 52, and consequently the skiving wheel 49, transversely of the web 7.

Figure 3:
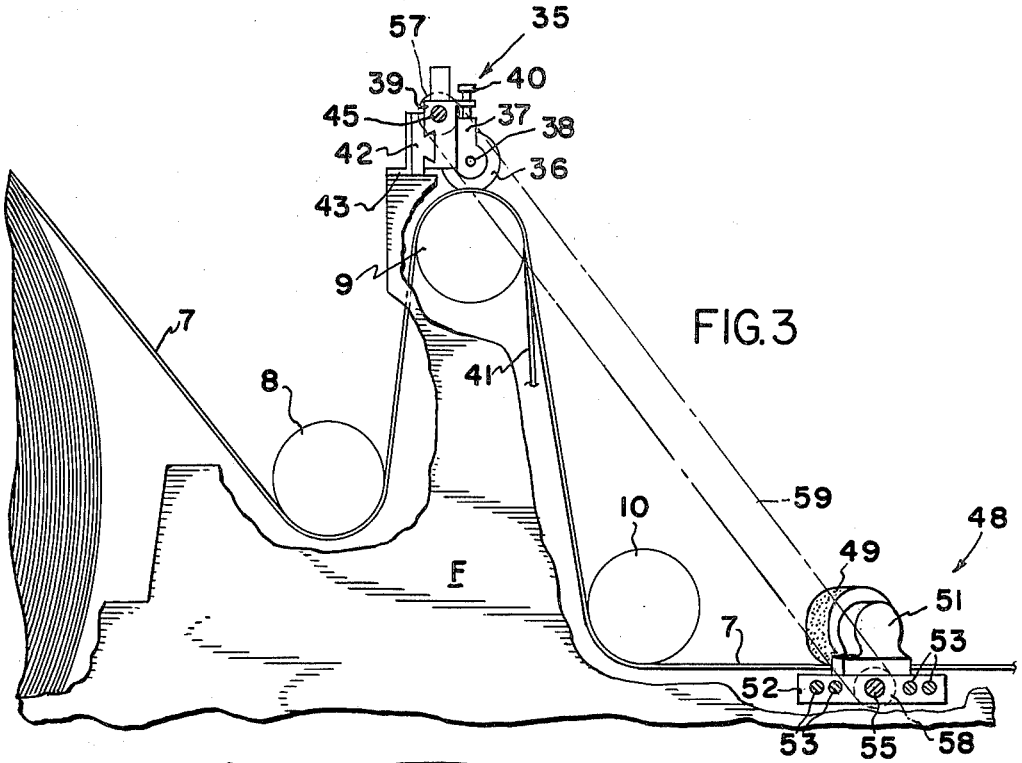
FIG. 3 is an enlarged, side elevational view of apparatus constructed according to the invention.

The axis of rotation of the skiving wheel 49 is oblique with respect to the transverse dimension of the web 7 and the skiving wheel is rotated by the motor 51 clockwise, as viewed in FIG. 3. The position of the skiving wheel 49 relative to the edge of the web 7 should be such that the edge of the web 7 has a skived band 56 of gradually diminishing thickness in a direction toward the free edge of the web.

The skiving mechanism 48 may be adjustable independently of the slitting mechanism 35, but it is preferred that the two mechanisms be interconnected so as to be adjustable simultaneously and in the same direction with respect to the transverse dimension of the web 7. Accordingly, the shaft 45 has a sprocket 57 fixed thereon and the shaft 55 has a corresponding sprocket 58 fixed thereon, and trained around the sprockets 57 and 58 is a driven chain 59. Since the threading of the shafts 45 and 55 is the same, rotation of the shaft 45 in one direction to effect adjustment of the slitting mechanism 35 transversely of the web 7 will effect corresponding adjustment of the skiving mechanism 48 so as to make it possible to provide the skived band 56 at the edge of the web 7 irrespective of the extent of adjustment of the width *w* of the web.

Figure 4:
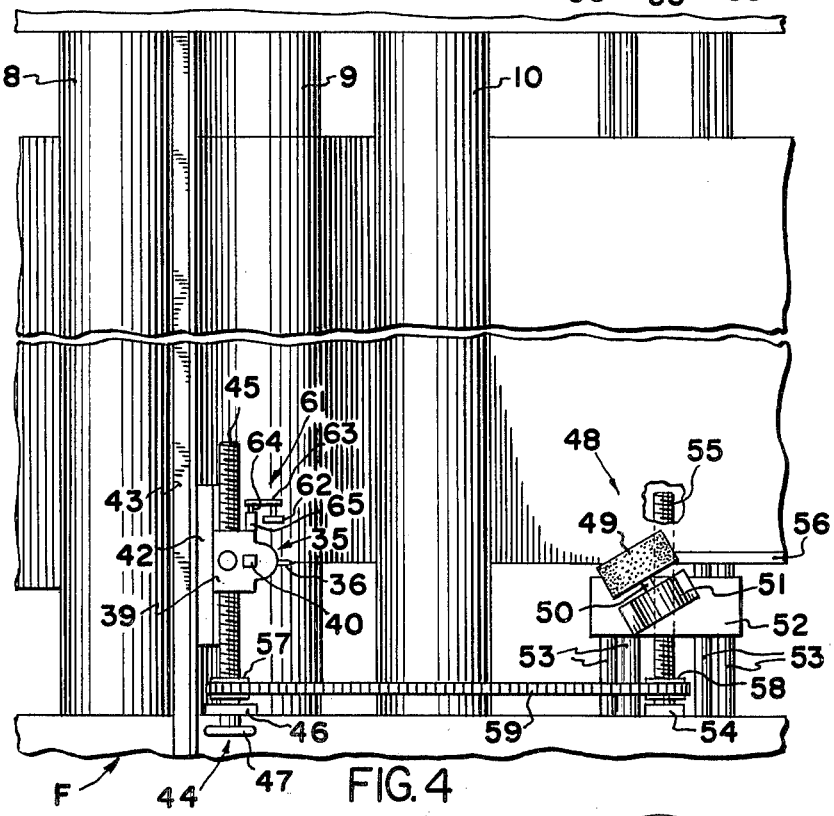
FIG. 4 is a top plan view of the apparatus shown in FIG. 3.

The transverse adjustments of the slitting and skiving mechanisms 35 and 48 may be effected manually, but it is preferred that such adjustments be made automatically. This may be accomplished by means of a sensor 61 (FIG. 4) comprising a roller 62 bearing against the web 7, and journaled at one end of an arm 63, the opposite end of which is fixed to a shaft 64 that extends into a housing 65 fixed to the carrier 39 and within which is contained a linearly variable differential transducer 66 such as that manufactured by Automatic Timing & Controls Company, King of Prussia, Pa. The transducer 66 includes a resistor 67 to which d.c. voltage is applied and a contact arm 68 that is fixed to the shaft 64. Rotation of the shaft 64 in one direction effects movement of the contact arm 68 in one direction transversely of the resistor 67, and rotation of the shaft 64 in the opposite direction effects opposite movement of the arm 68 transversely of the resistor. Movement of the contact arm 68 in either direction generates a signal in a bridge circuit (not shown) forming part of the transducer 66.

Figure 7:
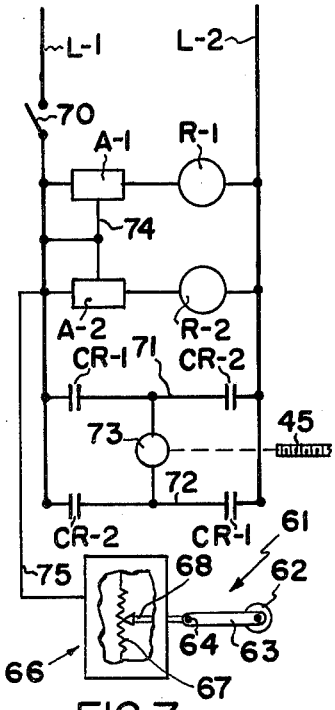
FIG. 7 is a schematic diagram of electrical control apparatus.

The transducer 66 forms part of an electrical control circuit illustrated in FIG. 7. The circuit includes power lines L-1 and L-2, in one of which is a master switch 70. Bridging the power lines is a relay R-1 and an amplifier A-1. Also bridging the power lines is a relay R-2 and an amplifier A-2. The relay R-1 includes two normally open contacts CR-1 and the relay R-2 also includes two normally open contacts CR-2. One contact CR-1 and one contact CR-2 are positioned in a line 71 which bridges the power lines and the other contacts CR-1 and CR-2 are positioned in a line 72 which also bridges the power lines. Connected to the lines 71 and 72 is a reversible motor 73 which may be coupled to the sprocket shaft 45. The amplifiers A-1 and A-2 are connected by a line 74 which, in turn, is connected to the output line 75 of the transducer 66.

The construction and arrangement of the control circuit are such that, as long as no rotation of the sensor shaft 64 occurs, the motor 73 is idle and the slitter and skiving mechanisms 35 and 48 remain in the positions to which they have been adjusted. Should the thickness of the web 7 increase, however, the roller 62 will be displaced upwardly, thereby effecting rotation of the sensor shaft 64 and displacement of the contact arm 68 of the transducer 66. Such displacement will unbalance the bridge circuit of the transducer and generate a signal which will be delivered to the amplifier A-1 so as to energize the relay CR-1. Energization of the relay R-1 will close the two associated contacts CR-1, thereby completing a circuit to the motor 73, whereby the shaft 45 is rotated in such direction as to cause movement of the slitter mechanism 35 in a direction to decrease the width *w* of the web. The motor 73 is energized only as long as the sensor shaft 64 is rotated.

When the thickness of the web 7 decreases, the sensor shaft 64 is rotated in the opposite direction, whereby the control circuit is energized via the relay R-2, the amplifier A-2, and the contacts CR-2 to drive the motor 73 in a direction to adjust the slitter mechanism in a direction to increase the width of the web *w*.

Figure 2:
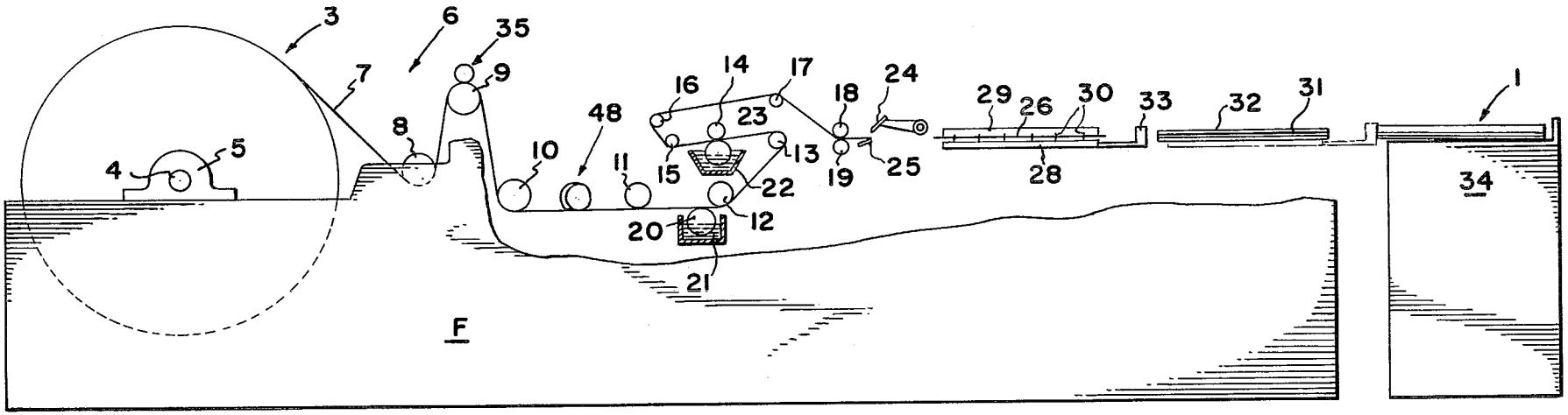
FIG. 2 is a side elevational view of the apparatus shown in FIG. 1.

At the commencement of the tube winding operation, the web 7 is unwound from the roll 3 and is trained around the several rollers of the unwinding machine in the manner best indicated in FIG. 2. Initially, the slitting mechanism 35 and the sensor roller 62 may be adjusted to positions in which they do not engage the web, but the skiving mechanism 48 should be adjusted to a position in which it does skive the edge of the web. Thereafter, the unwinding machinery may be started so as to produce successive blanks 26, each of which is wound into a tube 1.

As the finished tubes are produced the diameters of the tubes 1 are measured. If the diameter of the last tube inspected is too large, the slitting mechanism 35 may be adjusted transversely of the web 7 so as to trim a strip 41 from the web and thereby enable the production of blanks 26 which are of uniform length, but which have a width less than the width of the previously produced blanks. Such blanks then are rolled to form tubes the diameter of which again can be inspected. The diameter of these tubes will be less than the diameter of the previously wound tubes inasmuch as the width of the blanks has been reduced. Further adjustments of the slitting mechanism 35 in either direction transversely of the web may be made as required to produce tubes of uniform diameter and the adjustment of the slitting mechanism may be effected without discontinuing operation of the roll unwinding and tube winding process. Due to the interconnection of the adjusting means of the slitting apparatus 35 and the skiving apparatus 48, any adjustment of the slitting apparatus effects a corresponding adjustment of the skiving apparatus so as to enable the edge of each blank 26 to be skived.

When tubes of the desired diameter are being produced, the sensor roller may be placed in contact with the web 7 and the switch 70 closed, whereupon adjustments of the slitting and skiving mechanisms thereafter will be effected automatically.

The disclosed apparatus and process are representative of presently preferred forms of the invention, but are intended to be illustrative rather than definitive thereof. The invention is defined in the claims.

I claim:

1. In a method of winding substantially uniform diameter tubes from a web of varying thickness sheet material which is cut transversely at successive intervals to form blanks of predetermined length and width, each of which blanks subsequently is wound upon itself from one side edge thereof toward its other side edge to form a tube, the improvement comprising varying the width of successive blanks inversely with changes in the thickness of said sheet material.

2. A method according to claim 1 including skiving said other side edge of each of said blanks prior to its being wound.

3. A method according to claim 1 wherein said sheet material is wound on a roll from which said web is unwound.

4. A method according to claim 1 wherein said web is cut longitudinally along one side thereof prior to its being cut transversely into blanks.

5. A method according to claim 4 wherein said one side of said web is skived following its being cut longitudinally and prior to its being cut transversely into blanks.

6. A method according to claim 1 including applying a coating of adhesive to one surface of said web prior to its being cut transversely into blanks.

7. A method according to claim 1 wherein said web is moved continuously.

8. A method according to claim 7 including skiving said other edge of said web prior to its being cut transversely.

9. A method according to claim 8 including maintaining substantially constant the skived area of said other edge of said web.

10. Apparatus for use in the winding of substantially uniform diameter tubes from a web of varying thickness sheet material unwound continuously from a roll and subsequently cut into successive blanks which are wound upon themselves to form said tubes, said apparatus comprising cutting means for cutting said web longitudinally thereof adjacent one edge thereof; means mounting said cutting means for movements transversely of said web; operating means for moving said cutting means transversely of said web as the latter is unwound from said roll; sensing means operable to sense changes in the thickness of said sheet material; and control means coupling said cutting means and said sensing means and responsive to sensing by the latter of a change in thickness of said sheet material to move said cutting means transversely of said web in such direction as to vary the width of said sheet material inversely with changes in its thickness.

11. Apparatus according to claim 10 including skiving means for skiving one edge of said web; means mounting said skiving means for movements transversely of said web; and operating means for moving said skiving means transversely of said web as the latter is unwound from said roll.

12. Apparatus according to claim 11 including means interconnecting the operating means of said cutting means and the operating means of said skiving means for effecting simultaneous operation of both of said operating means.

* * * * *